US007587920B2

(12) United States Patent
Kim

(10) Patent No.: US 7,587,920 B2
(45) Date of Patent: Sep. 15, 2009

(54) HYDRO FORMING APPARATUS FOR MAKING U-SHAPED PRODUCTS

(75) Inventor: Younghun Kim, Ulsan (KR)

(73) Assignee: Hyundai Motor Company, Seoul (KR)

( * ) Notice: Subject to any disclaimer, the term of this patent is extended or adjusted under 35 U.S.C. 154(b) by 276 days.

(21) Appl. No.: 11/636,102

(22) Filed: Dec. 8, 2006

(65) Prior Publication Data

US 2008/0105020 A1 May 8, 2008

(30) Foreign Application Priority Data

Nov. 8, 2006 (KR) ..... 10-2006-0110043

(51) Int. Cl.
*B23P 17/00* (2006.01)
*B21D 7/08* (2006.01)

(52) U.S. Cl. ..... 72/58; 72/57; 72/62

(58) Field of Classification Search ..... 72/56, 72/57, 58, 60, 61, 62; 29/421.1
See application file for complete search history.

(56) References Cited

U.S. PATENT DOCUMENTS 4,567,743 A * 2/1986 Cudini ..... 72/61
5,239,852 A * 8/1993 Roper ..... 72/58
5,333,775 A * 8/1994 Bruggemann et al. ..... 72/61
5,339,667 A * 8/1994 Shah et al. ..... 72/58
5,557,961 A * 9/1996 Ni et al. ..... 72/61
5,884,722 A * 3/1999 Durand et al. ..... 29/897.2
6,098,437 A * 8/2000 Kocer et al. ..... 72/55
6,807,839 B2 * 10/2004 Takamatu ..... 72/57
7,017,249 B2 * 3/2006 Brereton et al. ..... 29/421.1

* cited by examiner

*Primary Examiner*—David B Jones
(74) *Attorney, Agent, or Firm*—Edwards Angell Palmer & Dodge LLP; Peter F. Corless

(57) ABSTRACT

A hydro forming apparatus comprises a lower base; a lower mold mounted on the lower base and provided with an U-shaped lower cavity; an upper mold provided with a U-shaped upper cavity corresponding to the lower cavity and configured to be coupled with the lower mold; an upper base mounted on the upper mold and configured to be coupled with the lower base; and an adjusting unit for adjusting the shape of the U-shaped lower and upper cavities.

9 Claims, 11 Drawing Sheets

HYDRO FORMING APPARATUS FOR MAKING U-SHAPED PRODUCTS

CROSS-REFERENCE TO RELATED APPLICATION

This application claims priority to and the benefit of Korean Patent Application No. 10-2006-0110043 filed in the Korean Intellectual Property Office on Nov. 8, 2006, the entire contents of which are incorporated herein by reference.

BACKGROUND OF THE INVENTION (a) Field of the Invention

The present invention relates to a hydro forming apparatus for making U-shaped products. More particularly, the present invention relates to a hydro forming apparatus for making U-shaped products, which can adjust a shape of bent tube thereby improving product quality.

(b) Background

Referring to FIG. 10, a process for making U-shaped products will be described in detail.

As shown in FIG. 10, after a tube is bent into a U-shaped tube, the U-shaped tube is free formed into a rough U-shaped product. After that, a hydro forming process is performed by applying hydraulic pressure to the free formed U-shaped tube and a U-shape product is made by cutting ends of the tube.

In a case that a tube is bent into a U-shaped tube, the bent tube tends to restore its original shape to some degree, instead of maintaining its bent shape. This phenomenon is called spring back. For this reason, the bent tube should be further bent so as to complete a bending process. If a bent tube that does not undergo such adjusting process is inserted in a hydro forming apparatus, as shown in FIG. 11, pinching may occur and production quality may be deteriorated.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide an improved hydro forming apparatus that can adjust the shape of a bent tube before hydro forming the tube.

In one aspect, the present invention provides a hydro forming apparatus comprising: a lower base; a lower mold mounted on the lower base and provided with an U-shaped lower cavity; an upper mold provided with a U-shaped upper cavity corresponding to the lower cavity and configured to be coupled with the lower mold; an upper base mounted on the upper mold and configured to be coupled with the lower base; and an adjusting unit for adjusting the shape of the U-shaped lower and upper cavities.

The adjusting unit may preferably include a first adjusting unit for adjusting ends of the U-shaped lower and upper cavities; and a second adjusting unit for adjusting side portions of the U-shaped lower and upper cavities.

The first and second adjusting units may respectively include an adjusting bolt and a push rod configured to be screwed to the adjusting bolt.

A lower plate may be disposed between the lower base and the lower mold, and an upper plate may be disposed between the upper base and the upper mold.

The lower and upper plates may be respectively divided into two pieces and each piece may be rotatably connected to the lower and upper bases.

Each piece of the lower and upper plates may be hinged to the lower and upper bases, respectively.

A first position checking pin may be mounted on the lower plate and be coupled with the upper plate through an end of the lower cavity.

A second position checking pin may be mounted on the upper plate, and one end of the second position checking pin may be connected to a side portion of the upper cavity.

The other end of the second position checking pin may penetrate through the upper base.

Figure 1:
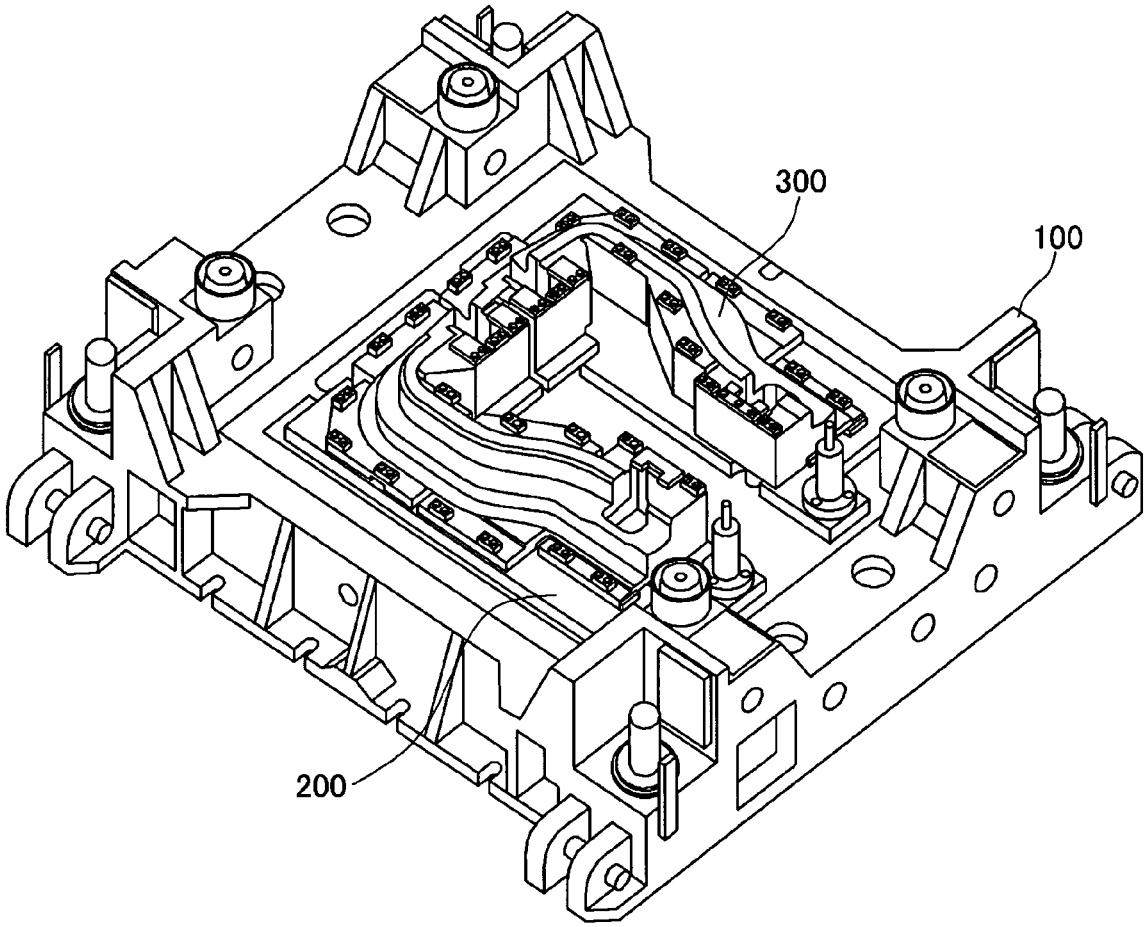
FIG. 1 is a perspective view showing a lower base and a lower mold coupled with each other according to an exemplary embodiment of the present invention.

Reference numerals set forth in the Drawings includes reference to the following elements as further discussed below:

| | |
|---|---|
| 100: lower base | 200: lower plate |
| 300: lower mold | 400: upper mold |
| 500: upper plate | 600: upper base |

DETAILED DESCRIPTION

An exemplary embodiment of the present invention will hereinafter be described in detail with reference to the accompanying drawings.

Figure 5:
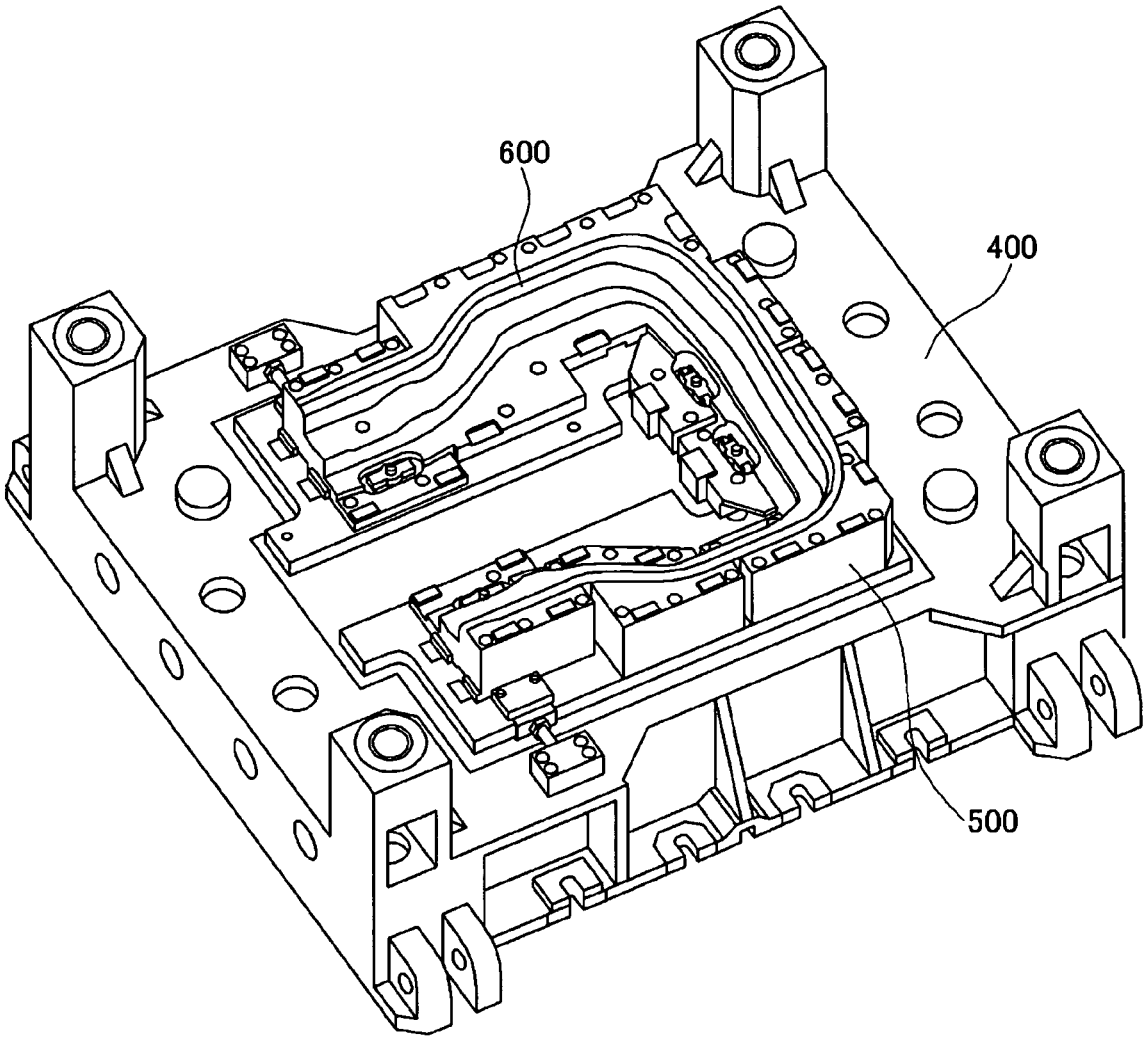
FIG. 5 is a perspective view showing an upper base and an upper mold coupled with each other according an exemplary embodiment of the present invention.

As discussed above, in one aspect, the present invention provides a hydro forming apparatus for making U-shape products, comprising: a lower base; a lower mold mounted on the lower base and provided with an U-shaped lower cavity; an upper mold provided with a U-shaped upper cavity corresponding to the lower cavity and configured to be coupled with the lower mold; an upper base mounted on the upper mold and configured to be coupled with the lower base; and an adjusting unit for adjusting the shape of U-shaped lower and upper cavities FIG. 1 is a perspective view showing a lower base and a lower mold coupled with each other, and FIG. 5 is a perspective view showing an upper base and an upper mold coupled with each other according an exemplary embodiment of the present invention.

As shown in FIG. 1 and FIG. 5, an exemplary hydro forming apparatus for making U-shaped products according to an embodiment of the present invention includes a lower base 100, a lower plate 200, a lower mold 300, an upper mold 600, an upper plate 500, and an upper base 400.

The lower mold 300 is mounted on the lower base 100, and the lower plate 200 is disposed between the lower base 100 and the lower mold 300.

The upper mold 600 is mounted under the upper base 400, and the upper plate 500 is disposed between the upper base 600 and the upper mold 600.

The lower mold 300 is coupled with the upper mold 600, and the lower base 100 is coupled with the upper base 400.

Figure 2:
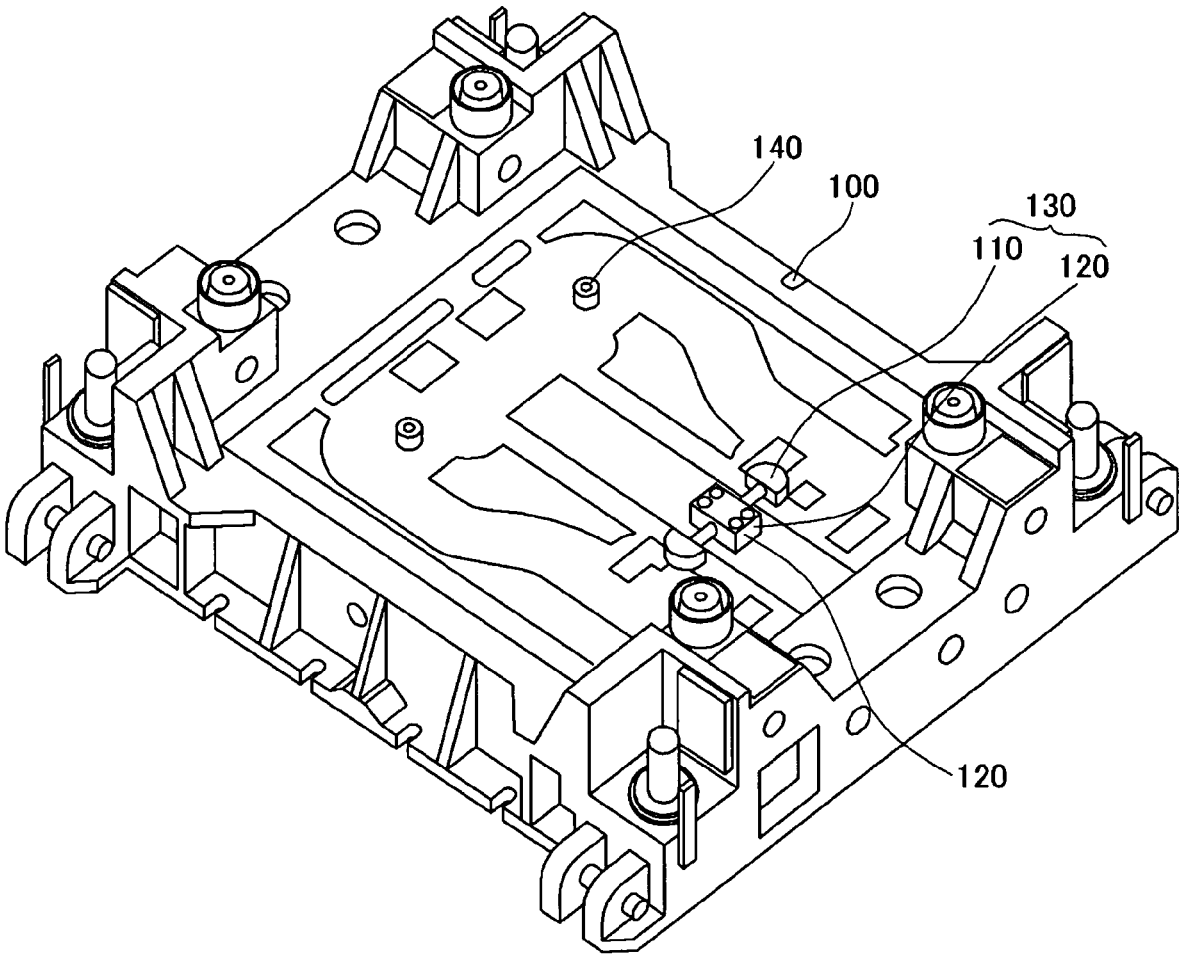
FIG. 2 is a perspective view showing a lower base of a hydro forming apparatus for making U-shaped products according to an exemplary embodiment of the present invention.

As shown in FIG. 2, the lower base 100 is provided with a first adjusting unit 130 and a hinge receiving groove 140.

The first adjusting unit 130 includes an adjusting bolt 120 and push rods 110 connected to two sides of the adjusting bolt 120. Each of the push rods 110 is configured to be screwed to the adjusting bolt 120. Each of the push rods 110 can move outward of the adjusting bolt 120 or moves inward of the adjusting bolt 120 when the adjusting bolt 120 is rotated.

One end of a hinge shaft (not shown) is inserted in the hinge receiving groove 140.

Figure 3:
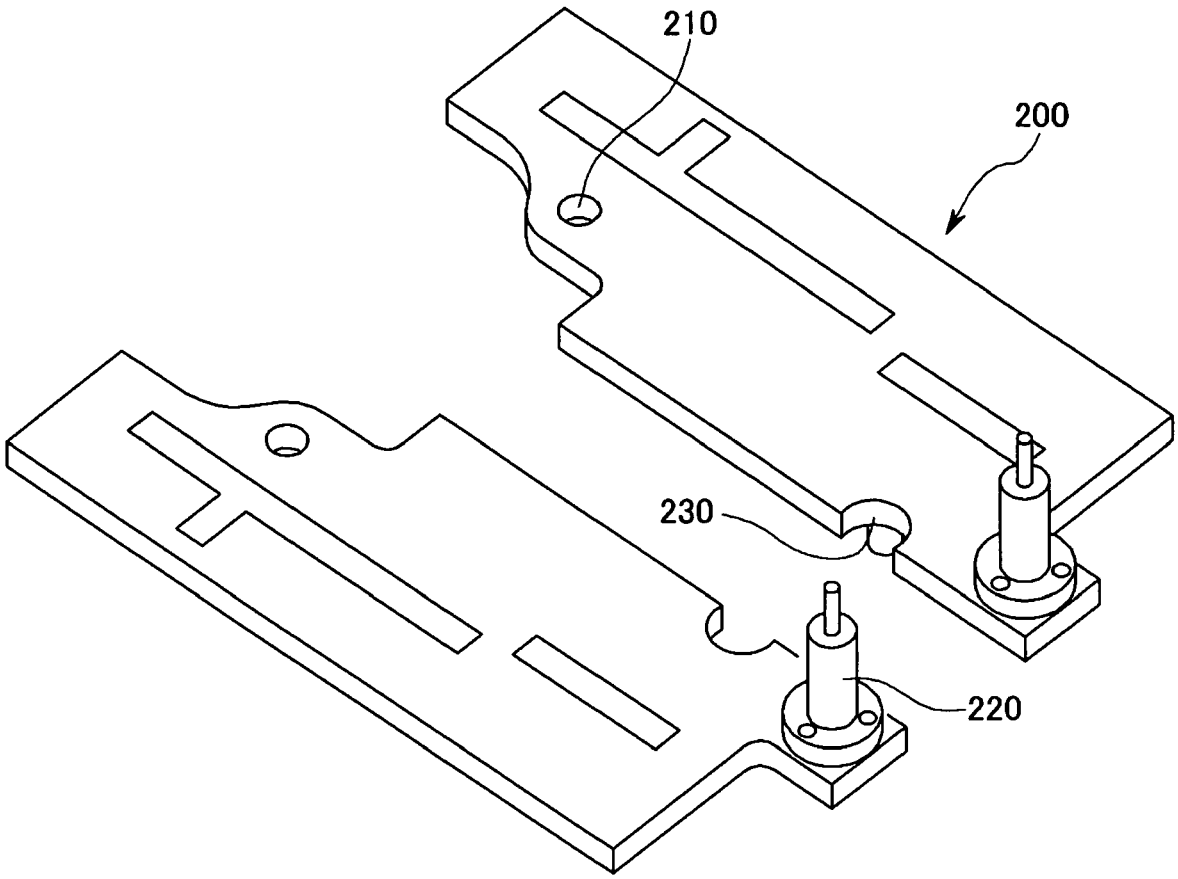
FIG. 3 is a perspective view showing a lower plate of a hydro forming apparatus for making U-shaped products according to an exemplary embodiment of the present invention.

As shown in FIG. 3, the lower plate 200 is divided into two pieces, and each piece is rotatably connected to the lower base 100. The lower plate 200 is provided with a first adjusting unit receiving groove 230, a first position checking pin 220, and a hinge insert hole 210.

The push rod 110 of the first adjusting unit 130 is inserted in the first adjusting unit receiving groove 230 so that the push rod 110 may push the lower plate 200.

In addition, the hinge insert hole 210 is formed at each piece of the lower plate 200. The hinge shaft inserted in the hinge receiving groove 140 of the lower base 100 penetrates into the hinge insert hole 210. In other words, each piece of the lower plate 200 is rotatably connected to the lower base 100 with reference to the hinge shaft.

Figure 4:
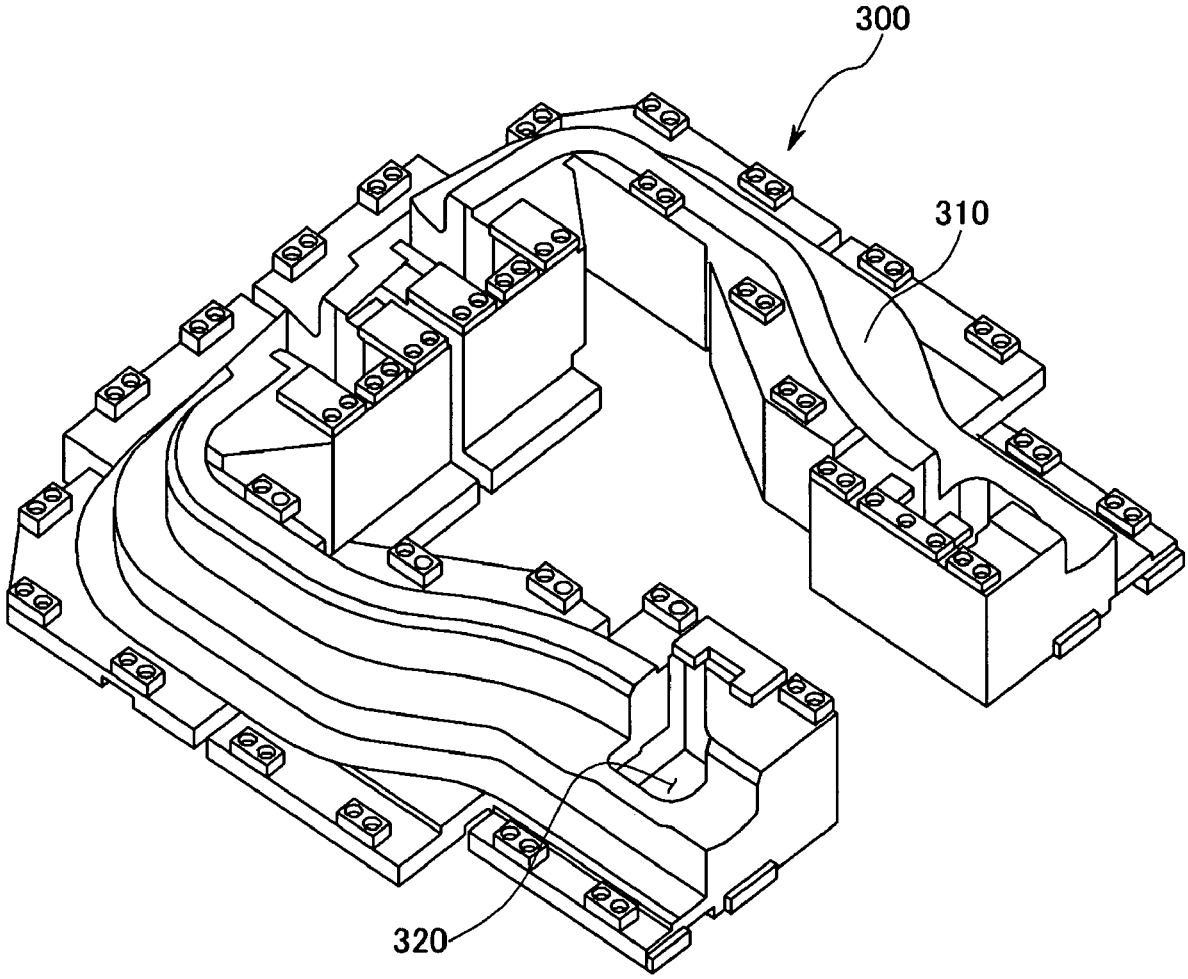
FIG. 4 is a perspective view showing a lower mold of a hydro forming apparatus for making U-shaped products according to an exemplary embodiment of the present invention.

As shown in FIG. 4, the lower mold 300 is provided with a lower cavity 310 and a position checking pin insert hole 320. A forming surface is formed on the lower cavity 310. The lower cavity 310 is substantially U-shaped such that a bent tube is inserted therein. The first position checking pin insert hole 320 is formed at ends of the U-shaped lower cavity 310, and the first position checking pin 220 is configured to be coupled to the upper plate 500 through the first position checking pin insert hole 320.

Therefore, when a user controls the first adjusting unit 130 and rotates each piece of the lower plate 200 with reference to the hinge shaft, the ends of the U-shaped lower cavity 310 can be rotated by the first position checking pin 220, and accordingly, ends of the bent tube can be adjusted.

Figure 6:
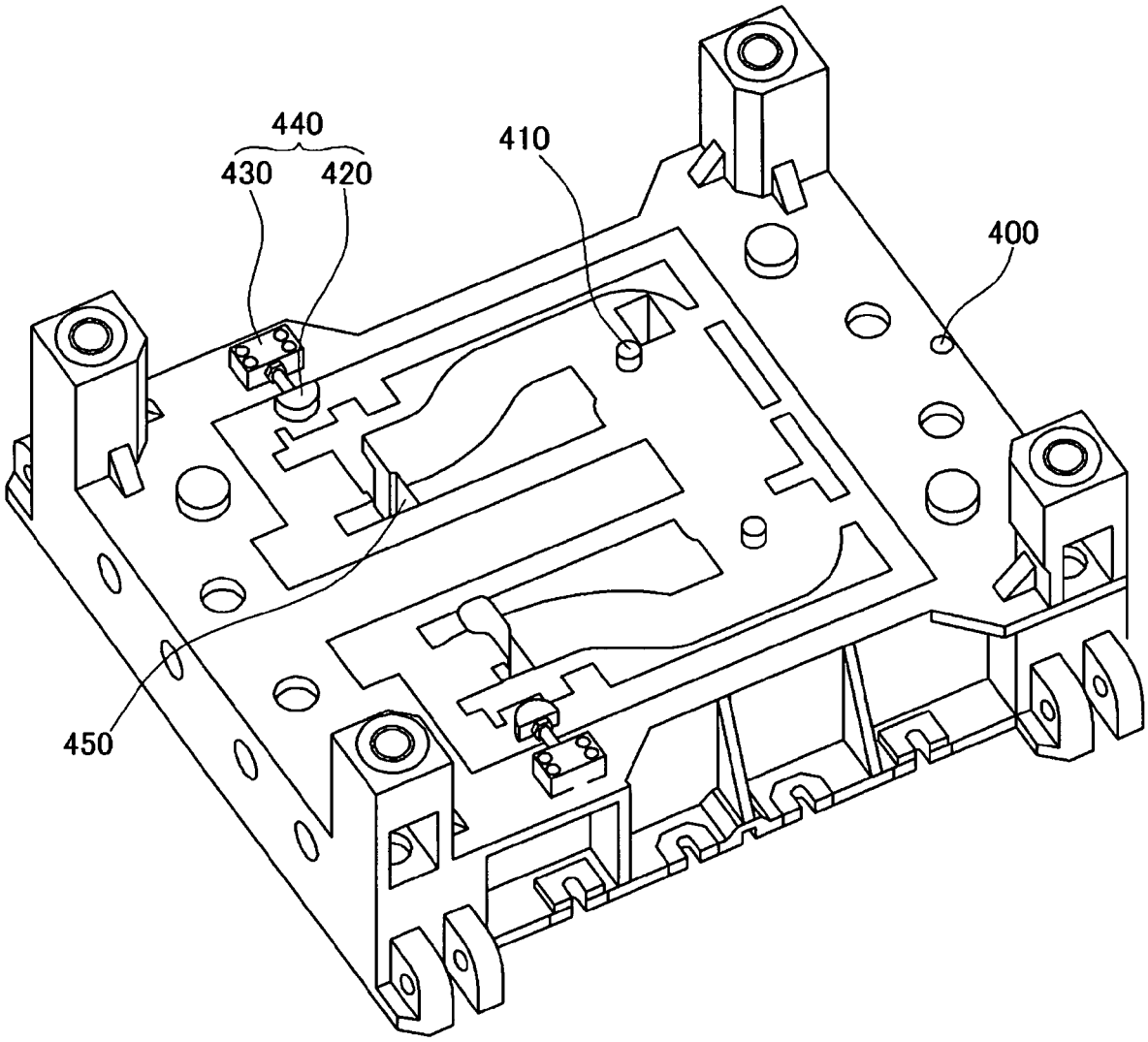
FIG. 6 is a perspective view showing an upper base of a hydro forming apparatus for making U-shaped products according to an exemplary embodiment of the present invention.

As shown in FIG. 6, the upper base 400 is provided with a hinge receiving groove 410 and a second position checking pin insert hole 450. In addition, a second adjusting unit 440 is mounted on the upper base 400.

The other end of the hinge shaft is to be inserted in the hinge receiving groove 410.

The second adjusting unit 440 includes an adjusting bolt 430 and a push rod 420 connected to a side of the adjusting bolt 430. Such second adjusting unit 440 is provided on left and right sides of the upper base 400.

Each of the push rods 420 is configured to be screwed to the adjusting bolt 430. Therefore, each of the push rods 420 can move outward of the adjusting bolt 430 or move inward of the adjusting bolt 430 when the adjusting bolt 430 is rotated.

Figure 7:
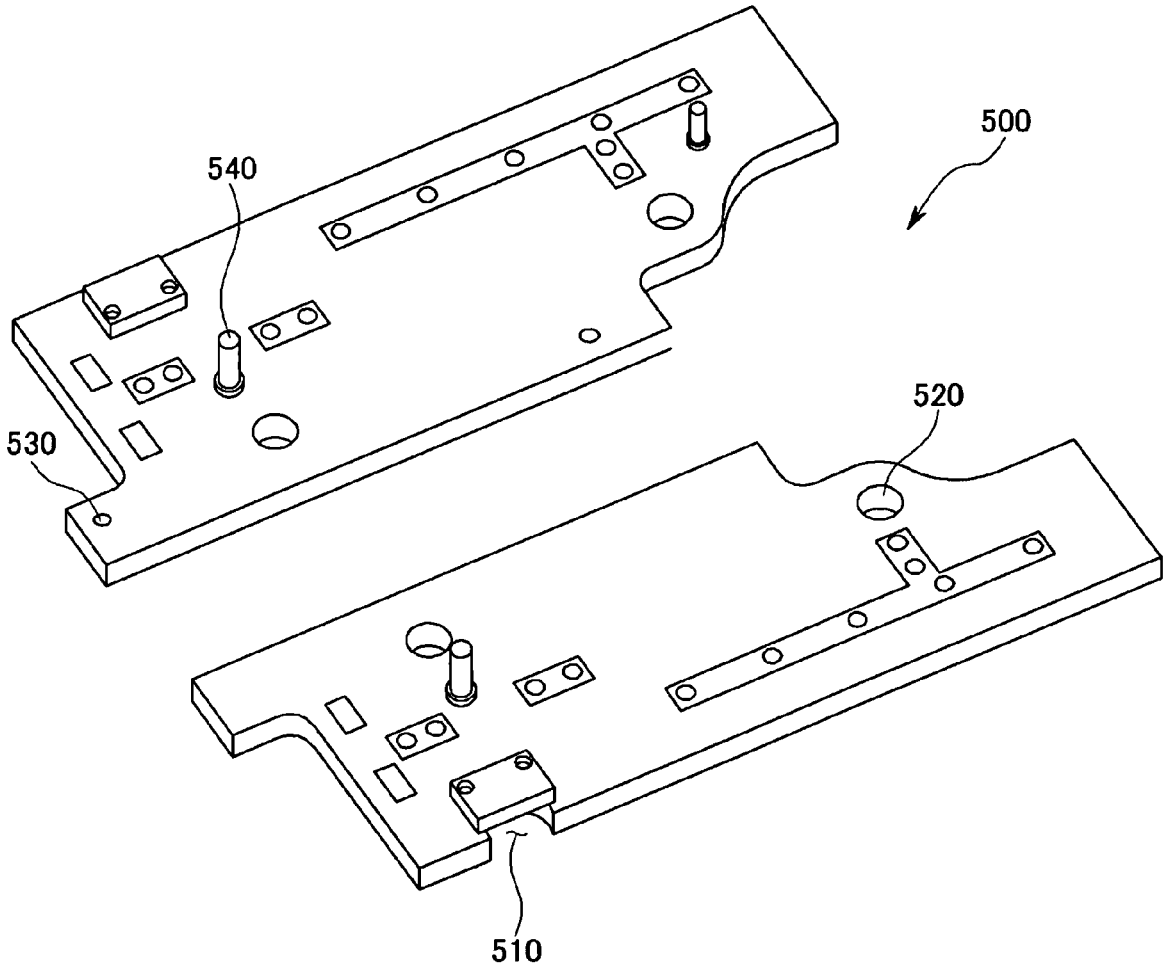
FIG. 7 is a perspective view showing an upper plate of a hydro forming apparatus for making U-shaped products according to an exemplary embodiment of the present invention.

As shown in FIG. 7, the upper plate 500 is divided into two pieces, and each piece is rotatably connected to the upper base 400. The upper plate 500 is provided with a second adjusting unit receiving groove 510, a hinge insert hole 520, and a first position checking pin receiving groove 530. In addition, a second position checking pin 540 is mounted on the upper plate 500.

The second adjusting unit receiving grooves 510 are formed at left and right sides of the upper plate 500, and the push rod 420 of the second adjusting unit 440 is to be inserted in the second adjusting unit receiving grooves 510.

The hinge insert hole 520 is formed on each piece of the upper plate 500. The other end of the hinge shaft, which penetrates the hinge insert hole 210 of the lower plate 200, is inserted in the hinge receiving groove 410 of the upper base 400 through the hinge insert hole 520 of the upper plate 500. Therefore, each piece of the upper plate 500 is rotatably connected to the upper base 400 with reference to the hinge shaft.

One end of the first position checking pin 220 mounted at the lower plate 200 is inserted in the first position checking pin receiving groove 530. Therefore, the lower and upper plates 200 and 500 are simultaneously rotated by the first position checking pin 220.

The second position checking pin 540 has one end inserted in the upper mold 600 and the other end penetrating the second position checking pin insert holes 450.

Figure 8:
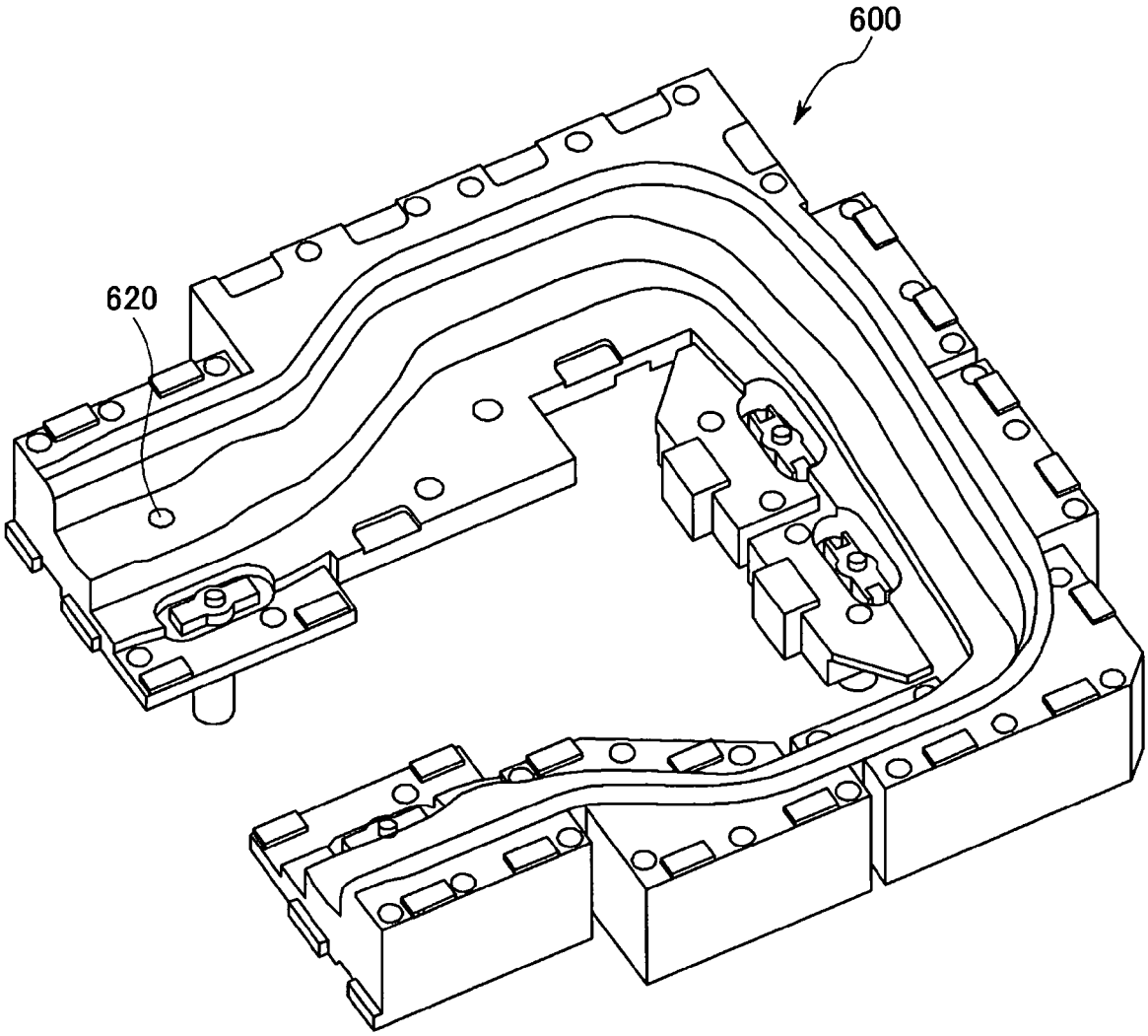
FIG. 8 is a perspective view showing an upper mold of a hydro forming apparatus for making U-shaped products according to an exemplary embodiment of the present invention.

As shown in FIG. 8, the upper mold 600 is provided with a U-shaped upper cavity 610 corresponding to the lower cavity 310 of the lower mold 300. Second position checking pin receiving grooves 620 are formed at left and right sides of the U-shaped upper cavity 610. The second position checking pin 540 is to be inserted in the second position checking pin receiving groove 620.

When a user controls the second adjusting unit 440, the push rod 420 of the second adjusting unit 440 pushes side portion of the upper cavity. Therefore, the side portion of the bent tube can be adjusted. In addition, the second position checking pin 540 inserted in the second position checking pin receiving groove 620 also moves and a user can check a shape of the side portion of the bent tube.

Hereinafter, an operation of the present invention will be described in detail.

Figure 9:
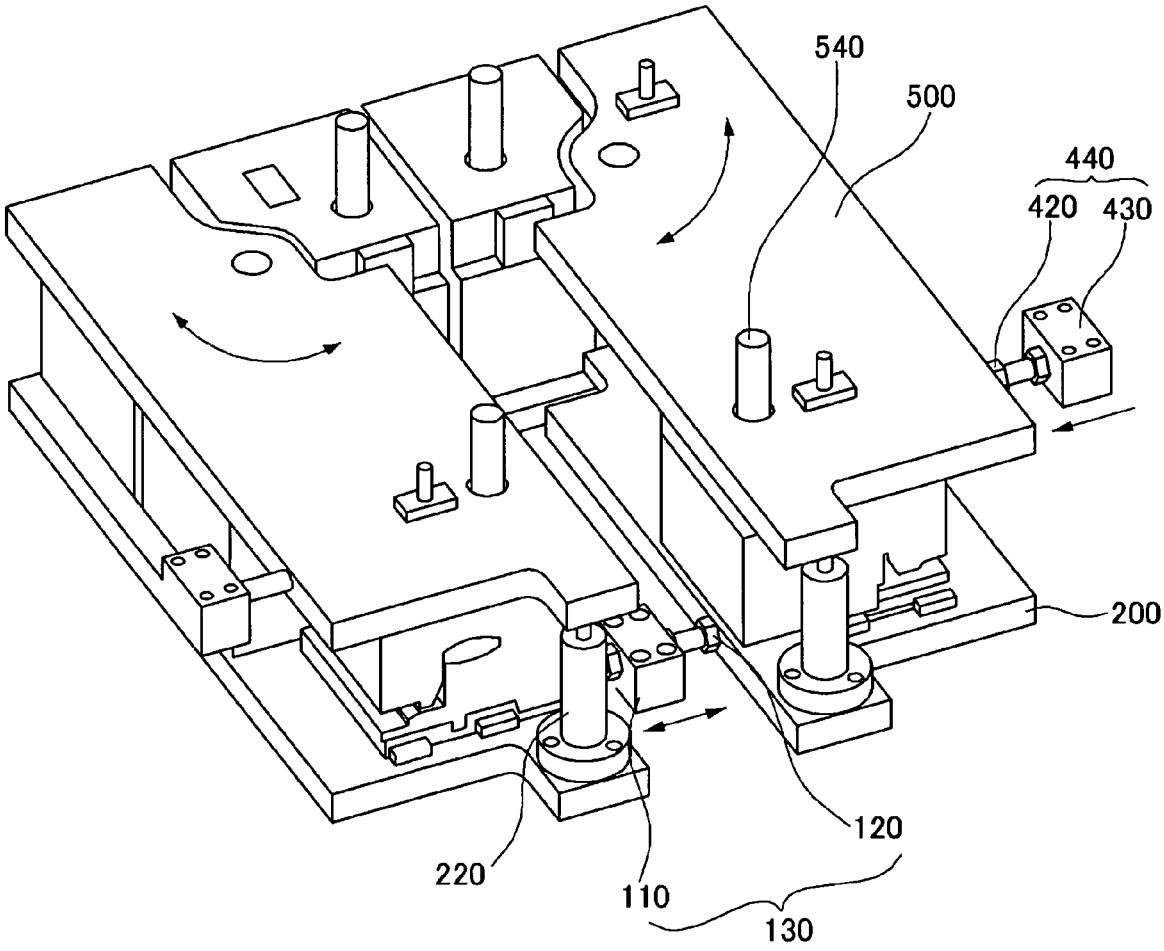
FIG. 9 is a perspective view showing upper and lower molds and upper and lower plates assembled with each other according to an exemplary embodiment of the present invention.
Figure 10:
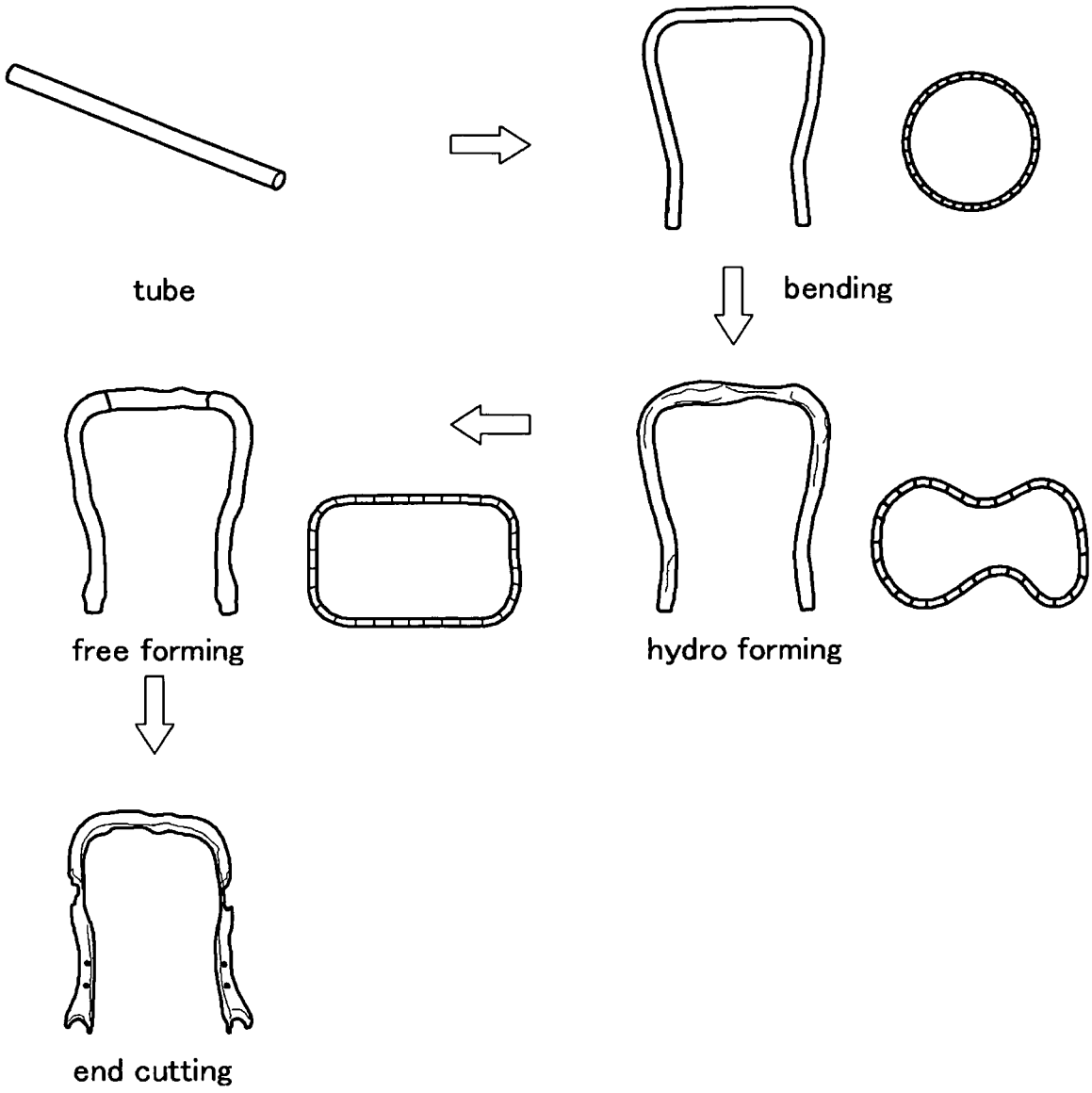
FIG. 10 is a schematic diagram showing a process for making U-shaped products.
Figure 11:
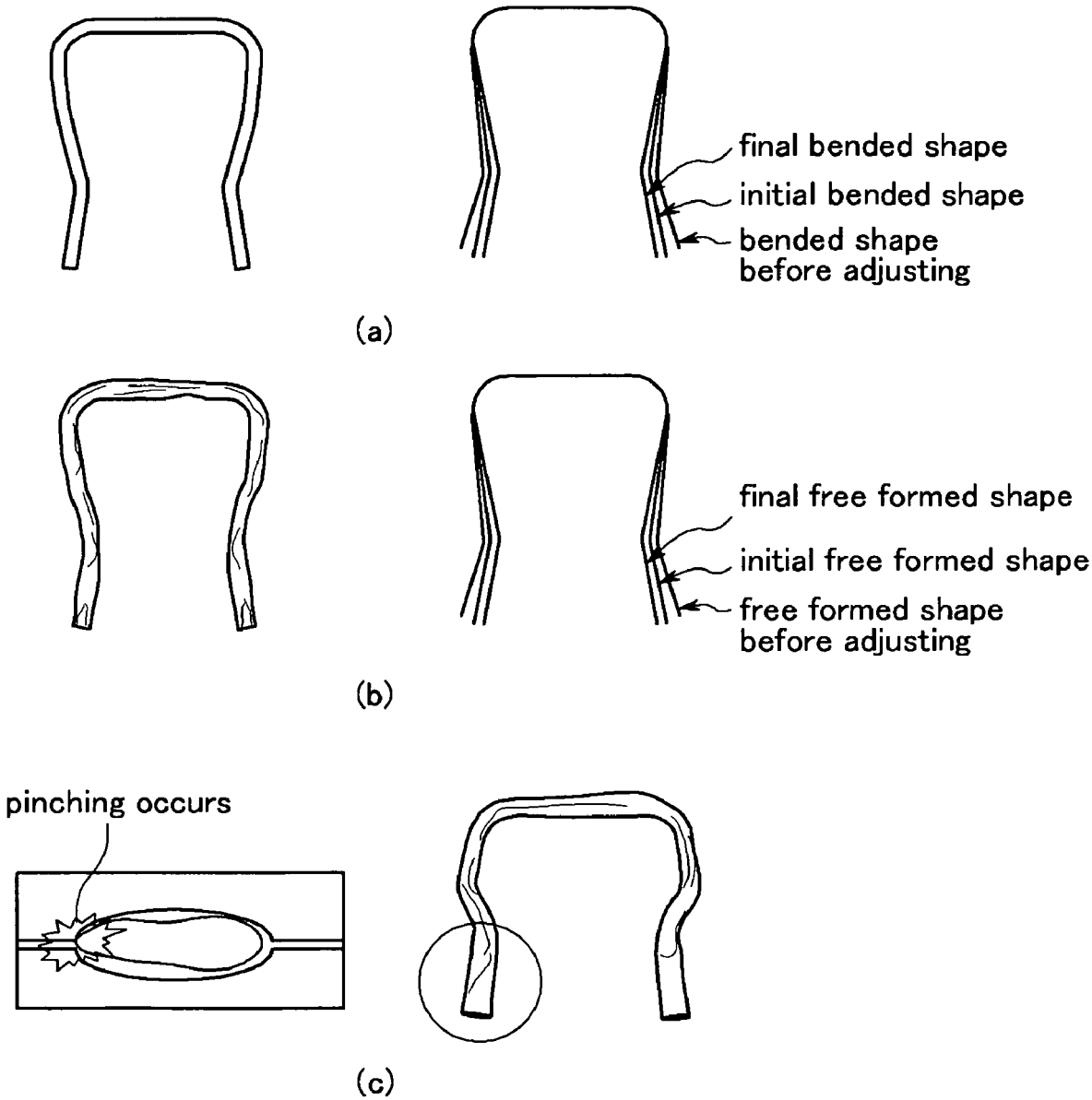
FIG. 11 is a schematic diagram showing problems occurred in a process for making U-shaped products.

As shown in FIG. 9, after a user uncouples the lower and upper bases 100 and 400 that are coupled with each other, a user rotates the adjusting bolt 120 of the first adjusting unit 130 and adjusts the shape of the ends of the U-shaped lower and upper cavities 310 and 610. A user can check the shape of the ends of the lower and upper cavities 310 and 610 by the position of the first position checking pin 220.

In addition, a user rotates the adjusting bolt 430 of the second adjusting unit 440 and adjusts the shape of the side portion of the U-shaped lower and upper cavities 310 and 610. A user can check the shape of the side portion of the lower and upper cavities 310 and 610 by the position of the second position checking pin 540.

After the shape of the lower and upper cavities 310 and 610 is adjusted, the lower and upper bases 100 and 400 are coupled with each other. After that, hydraulic pressure is applied to the U-shaped tube inserted in the lower and upper cavities 310 and 610 from a hydraulic pressure supplier (not shown) and a hydro forming process is completed.

According to the present invention, since a shape of a bent tube is easily adjusted and the adjusted tube undergoes a hydro forming process, product quality may be improved.

In addition, according to the present invention, since an additional adjusting process is not needed, working speed may be improved.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A hydro forming apparatus for making U-shaped products, comprising:

a lower base;

a lower mold mounted on the lower base and provided with a U-shaped lower cavity;

an upper mold provided with a U-shaped upper cavity corresponding to the lower cavity and configured to be coupled with the lower mold;

an upper base mounted on the upper mold and configured to be coupled with the lower base; and an adjusting unit for adjusting the shape of the U-shaped lower and upper cavities.

2. The apparatus of claim 1, wherein the adjusting unit comprises:

a first adjusting unit for adjusting position of ends of the U-shaped lower and upper cavities; and a second adjusting unit for adjusting position of side portions of the U-shaped lower and upper cavities.

3. The apparatus of claim 2, wherein the first and second adjusting units respectively comprise an adjusting bolt and a push rod that can be screwed to the adjusting bolt.

4. The apparatus of claim 1, wherein a lower plate is disposed between the lower base and the lower mold, and an upper plate is disposed between the upper base and the upper mold.

5. The apparatus of claim 4, wherein the lower and upper plates are respectively divided into two pieces and each piece is rotatably connected to the lower and upper bases.

6. The apparatus of claim 5, wherein each piece of the lower and upper plates is hinged to the lower and upper bases, respectively.

7. The apparatus of claim 4, wherein a first position checking pin is mounted on the lower plate and is coupled with the upper plate through an end of the lower cavity.

8. The apparatus of claim 4, wherein a second position checking pin is mounted on the upper plate, and one end of the second position checking pin is connected to a side portion of the upper cavity.

9. The apparatus of claim 8, wherein an other end of the second position checking pin penetrates through the upper base.

* * * * *